US011638975B2

(12) United States Patent
Veenendall et al.

(10) Patent No.: US 11,638,975 B2
(45) Date of Patent: May 2, 2023

(54) MOWER REEL GRINDING SYSTEM WITH ROTATING REAR BRACKETS

(71) Applicant: Foley United, LLC, River Falls, WI (US)

(72) Inventors: Gregory Veenendall, River Falls, WI (US); Matthew Thomford, Hudson, WI (US)

(73) Assignee: Foley United LLC, River Falls, WI (US)

( * ) Notice: Subject to any disclaimer, the term of this patent is extended or adjusted under 35 U.S.C. 154(b) by 899 days.

(21) Appl. No.: 16/269,525

(22) Filed: Feb. 6, 2019

(65) Prior Publication Data

US 2019/0240797 A1 Aug. 8, 2019

Related U.S. Application Data

(60) Provisional application No. 62/627,002, filed on Feb. 6, 2018.

(51) Int. Cl.
*B24B 3/42* (2006.01)
*B24B 3/36* (2006.01)

(52) U.S. Cl.
CPC ..... *B24B 3/42* (2013.01); *B24B 3/363* (2013.01)

(58) Field of Classification Search
CPC .. B24B 3/36; B24B 3/365; B24B 3/42; B24B 3/00; B24B 3/363
USPC ..... 451/45, 141, 233, 234, 235, 248, 367, 451/368, 371, 372, 373
See application file for complete search history.

(56) References Cited

U.S. PATENT DOCUMENTS 2,279,798 A * 4/1942 Shelburne ..... B24B 3/42 451/65
2,598,069 A 5/1952 Pine
2,718,097 A * 9/1955 Bradley ..... B24B 3/42 451/141
5,321,912 A * 6/1994 Neary ..... B24B 3/42 451/141
5,879,224 A * 3/1999 Pilger ..... B24B 3/42 451/403
6,010,394 A 1/2000 Dieck et al.
(Continued)

OTHER PUBLICATIONS

International Search Report and Written Opinion of the International Searching Authority for Application No. PCT/US2019/016930 dated Apr. 23, 2019 (12 pages).

*Primary Examiner* — Joel D Crandall
*Assistant Examiner* — Makena S Markman
(74) *Attorney, Agent, or Firm* — Dicke, Billig & Czaja, PLLC

(57) ABSTRACT

A mower reel grinding system a plurality of mower unit types, including a grinding wheel shaft, the grinding wheel shaft at a fixed position in an x-y plane. A mounting plate includes a number of predetermined fixed mounting positions on the mounting plate, each predetermined fixed mounting positions corresponding to at least one type of mower unit of the plurality of mower unit types, a mounting bracket to receive a mower unit, the mounting bracket selectively moveable to the predetermined fixed position corresponding to the mower unit type to be received thereby, and a pivot point about which the mounting plate rotates to adjust a position of the mounting bracket in the x-y plane relative to the grinding wheel shaft.

15 Claims, 11 Drawing Sheets

(56) References Cited

U.S. PATENT DOCUMENTS

| | | | | |
|---|---|---|---|---|
| 6,290,581 | B1 * | 9/2001 | Dieck | B24B 3/42 451/421 |
| 6,471,569 | B1 * | 10/2002 | Bernhard | B24B 41/066 451/224 |
| 6,699,103 | B1 * | 3/2004 | Dieck | B24B 3/365 451/141 |
| 7,231,849 | B2 * | 6/2007 | Beattie | B24B 3/42 76/82.1 |
| 9,028,295 | B2 * | 5/2015 | Bradnam | B24B 3/363 451/11 |
| 9,776,297 | B2 | 10/2017 | Veenendall et al. | |
| 2007/0184756 | A1 | 8/2007 | Dieck et al. | |
| 2016/0229020 | A1 * | 8/2016 | Veenendall | B24B 3/42 |

* cited by examiner

MOWER REEL GRINDING SYSTEM WITH ROTATING REAR BRACKETS

CROSS-REFERENCE TO RELATED APPLICATION

This application is a non-provisional of U.S. Application Ser. No. 62/627,002 filed Feb. 6, 2018, which is incorporated herein by reference.

BACKGROUND

Commercial mowers, such as those often used for maintaining golf courses, for example, typically use reel-type mowing units which employ cylindrical cutting reels having a number of helical blades disposed about a central shaft. To maintain optimal cutting performance, the helical blades of the cutting reels must be regularly sharpened.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

It is to be understood that the features of the various exemplary embodiments described herein may be combined with each other, unless specifically noted otherwise.

Commercial mowers, such as those often used for maintaining golf courses, for example, typically use reel-type mowing units which employ cylindrical cutting reels having a number of helical blades disposed about a central shaft. To maintain optimal cutting performance, the helical blades of the cutting reels must be regularly sharpened, preferably as close as possible to OEM (original equipment manufacturer) specifications. In view of the above, grinding systems have been developed to sharpen helical cutting blades of such mowing units.

Figure 1A:
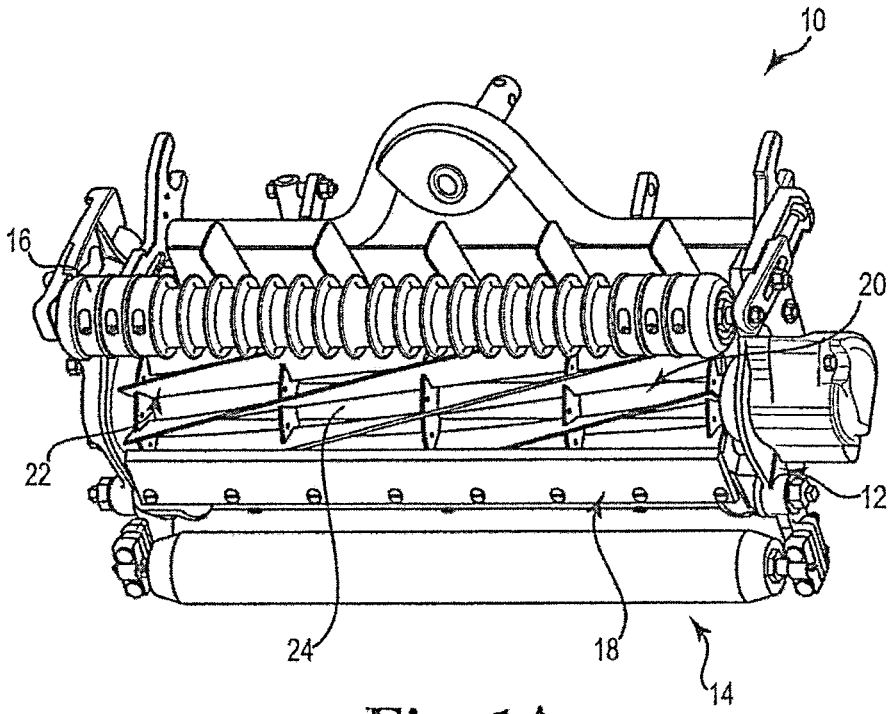
FIG. 1A is a perspective view of an example of a reel-type mower unit.

FIG. 1A is a bottom perspective view generally illustrating an example of a reel-type mower unit 10 for sharpening by a grinding system in accordance with the present disclosure. Reel-type mowing units, such as mower unit 10 typically include a frame structure 12 to which a rear roller 14, a front roller 16, a bedknife 18, and a cylindrical cutting reel 20 are mounted, wherein cutting reel 20 includes a number of helical blades 22 disposed about a shaft 24.

Figure 1B:
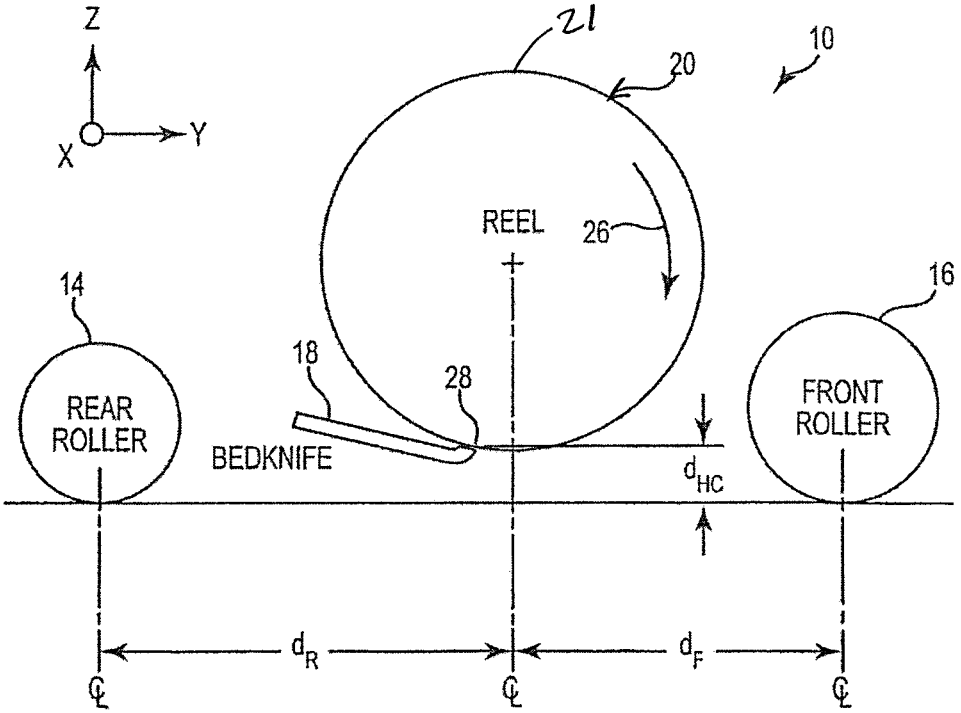
FIG. 1B is a schematic diagram generally illustrating a cross-sectional view of an example of a reel-type mower unit.

FIG. 1B is a simplified schematic diagram illustrating a cross-sectional view showing portions of a typical mower unit, such as mower unit 10. For ease of illustration, frame 12 is not shown in FIG. 1B. As reel 20 rotates, as indicated by rotational arrow 26, a perimeter surface 21 of reel 20 is defined by helical blades 22. It is noted that the so-called perimeter surface 21 is not a continuous surface, but is defined by the outer edges of surfaces of helical blades 22. While mowing, grass is cut at a sheer point 28 formed between the helical blades 22 and a leading edge of bedknife 18. A height of cut, cic, of the mower unit is typically adjusted by adjusting the vertical height (z-axis) of front roller 16 relative to central shaft 24 of cutting reel 20. A horizontal distance (y-axis) between a centerline of rear roller 14 and a centerline (i.e. axis of rotation) of cutting reel 20 is indicated as $d_R$, and a horizontal distance between a centerline of front roller 16 and the centerline of cutting reel 20 is indicated at $d_F$.

Because of the helical design of blades 22, while mowing, grass clippings are pushed toward one end of the cylindrical cutting reel such that blade wear is uneven, with the wear increasing from one end the other such that, over time, the perimeter surface 21 of cutting reel 20 may assume a conical shape rather than a cylindrical shape.

One type of grinding process is referred to as a "touch-off" grinding process. Typically, during "touch-off" grinding, a shaft of a grinding wheel used to sharpen cutting reel 20 is adjusted to be parallel with perimeter surface 21 of cutting reel 20. According to such process, the grinding wheel is first positioned at a first end of cutting reel 21, and grinding wheel shaft is adjusted until the grinding wheel touches the perimeter surface 21 of cutting reel 21. The grinding wheel is then positioned at a second end of cutting reel 20, opposite the first end, and adjusted until the grinding wheel touches perimeter surface 21. The grinding wheel is then moved back and forth in a reciprocating fashion along perimeter surface 21 of cutting reel 21 in the direction of shaft 24 of cutting reel 20, while cutting reel 20 is being about spun about shaft 24 counter to the direction of spin of the grinding wheel in order to grind or "square off" the edges of the helical blades 22.

While "touch off" grinding squares the edges of each helical blade 22, because the shaft of the grinding wheel is paralleled with perimeter surface 21 of the cutting reel 20, a "touch off" process does not "square" or "true" the overall shape of cutting reel 20 (i.e., it does not remove the conical shape). Since the grinding wheel is parallel to perimeter surface 21 of cutting reel 20, if the perimeter surface 21 of cutting reel 21 had a conical shape before touch-off grinding, the perimeter surface 21 of cutting reel 20 will maintain the conical shape after completion of the touch-off grinding process. If the conical shape of the cutting real is severe enough, performance of the cutting reel can be adversely affected. Also, if the grinding wheel shaft does not align closely enough with the direction of the rotational shaft 24 of cutting reel 20, the entirety of the edges of each of the helical blade 22*s* may not be sharpened. Users sometimes carry out the "touch off" grinding or sharpening process in order to save time (due to simplicity of the process) and/or when wear on a cutting reel is minimal.

Another type of grinding process, sometimes referred to herein as a "squaring process" or "trueing process" is carried out to return the perimeter surface 21 of cutting reel 20 to a true cylindrical shape. According to such a process, rather than paralleling the shaft grinding wheel to perimeter surface 21 of cutting reel 20, the grinding wheel shaft is paralleled with the rotational shaft 24 of cutting reel 20 in both a vertical direction (x-z plane) and a horizontal direction (x-y plane). The grinding wheel is then moved back and forth in a reciprocating fashion in the direction of shaft 24 of cutting reel 20 as cutting reel 20 is spun counter to the grinding wheel to thereby square-off each helical blade and, thereby square or true to cutting reel to a true cylindrical shape (i.e., removes the coning).

A third type of grinding process, sometimes referred to as a "relief grinding process", or simply "relief grinding" involves grinding a relief chamfer onto a back of each helical blade. According to one example, such process comprises a two-part process. In a first part, a "trueing" or "squaring" grinding process is carried out to ensure that the cutting reel has a true cylindrical shape. In a second part, a grinding wheel is successively guided along a back edge of each individual helical blade to create a relief or chamfer on the back edge which thereby forms a finer and more efficient cutting edge on each helical blade.

Figure 2A:
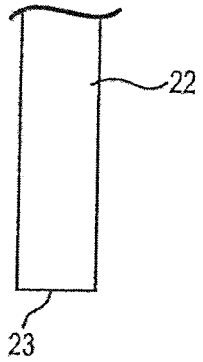
FIG. 2A is a schematic diagram generally illustrating a cross-sectional view of an example of a flat-ground helical blade.
Figure 2B:
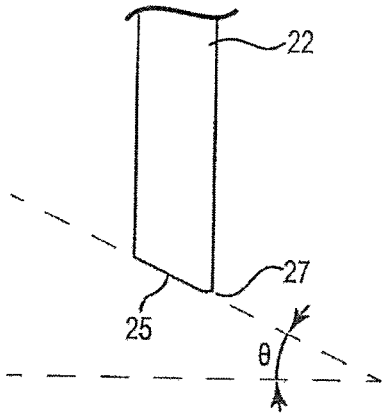
FIG. 2B is a schematic diagram generally illustrating a cross-sectional view of an example of a helical blade having a relief or chamfer.

FIG. 2A is a schematic diagram generally illustrating portions of a blade 22 after a spin grinding process, which includes positioning a grinding wheel of the grinding system and the cutting reel relative to one another so that the ends of all blades 22 of reel 20 are ground as cutting reel 20 is spun to "true" cutting reel 20 to a cylindrical shape. FIG. 2B is a schematic diagram generally illustrating blade 22 after a relief grinding process, where a grinding wheel is positioned to grind a relief bevel 25 having a relief angle θ onto a backside (or trailing edge) of blade 22 to form a cutting edge 27 that interacts with bedknife 18 to form sheer point 28.

In order to ensure that the grinding process returns reel 20 and blades 22 to OEM specifications, reel 20, and thus, helical blades 22, must be properly positioned and aligned relative to the grinding wheel(s) used during the grinding process. Some grinding systems secure to the front roller of the mower unit, such as front roller 16 of mower unit 10 illustrated above by FIGS. 1A and 2A, with some type of clamping/support structure. The support structure and grinding wheel are then adjusted relative to one another to achieve proper positioning of reel 20 relative to the grinding wheel. Such an adjustment process may be difficult, as the distance $d_F$ between the centerline of front roller 16 and the centerline of shaft 24 of cutting reel 20 is often different between mower units 10 from different manufactures, and is often different between models of mower units 10 from the same manufacturer. Furthermore, the front roller 16 can be positioned at different horizontal locations relative to shaft 24 for various purposes (e.g. for the installation of accessories such as groomers and brushes) so that distance dF can be different even between the same models of cutting units from the same manufacturer. As such, it is often necessary to adjust the positioning of the grinding system to achieve proper alignment each time a different mower unit 10 is to be sharpened, even when mowers units of the same model from the same manufacturer are being consecutively sharpened. Such alignments are time consuming and can result in inconsistent and undesirable grinding results.

In contrast to the distance $d_F$ between the centerlines of the front roller 16 and reel 20, while the vertical position of rear roller 14 may vary, the horizontal distance $d_R$ between the centerlines of the rear roller 14 and shaft 24 of cutting reel 20 of a given model of mowing unit is typically at a constant distance, or at least within a tight range of distances. Additionally, attachments and accessories, such as brushes, groomer, and thatchers, for example, are not typically mounted on the rear of the mowing units.

Figure 3:
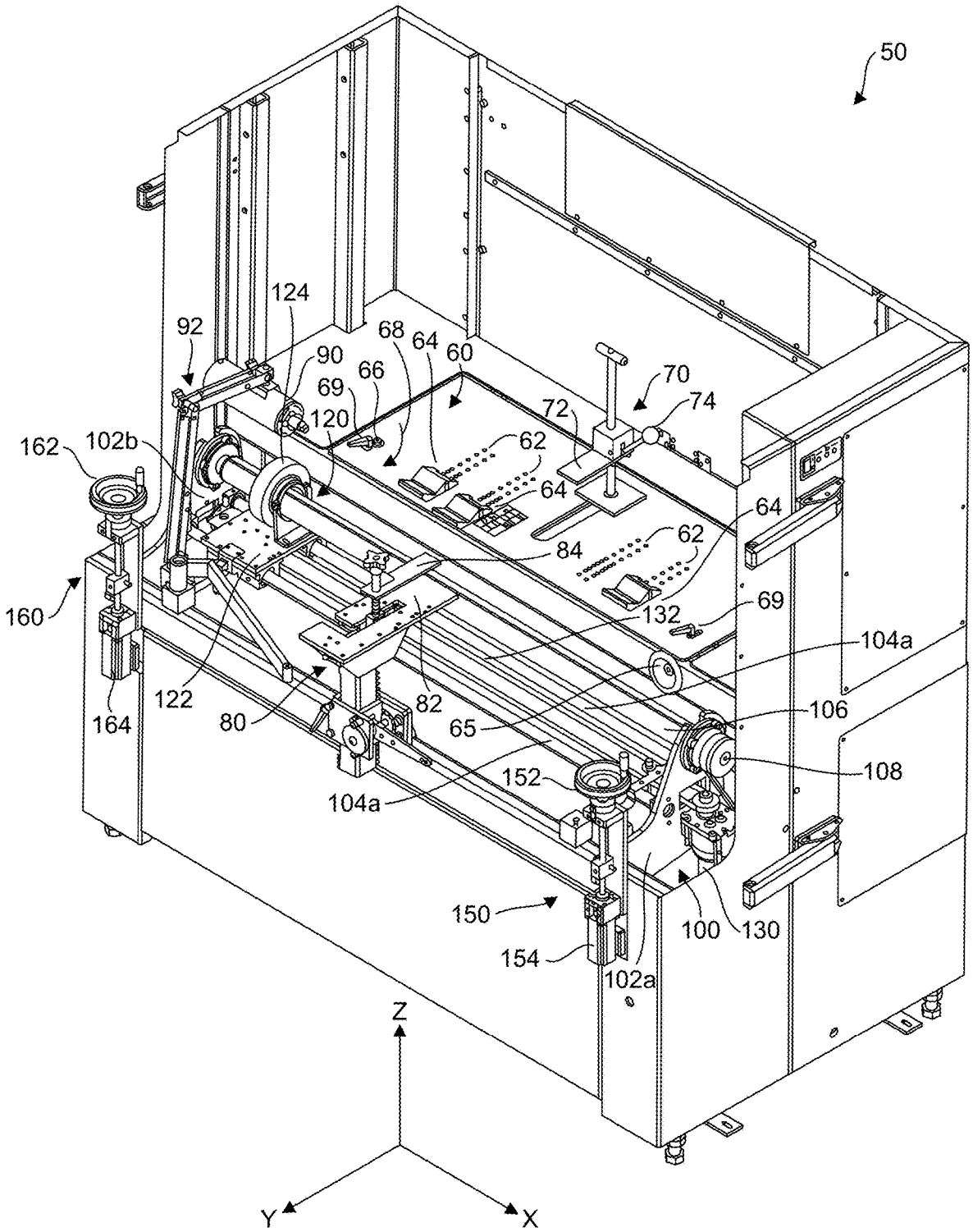
FIG. 3 is a perspective view of an example of a grinding system according to the present disclosure.

FIG. 3 is a perspective view illustrating portions of a grinding system 50, according to the present disclosure, which enables each of the above described grinding processes ("touch-off", "squaring/trueing" and "relief" grinding) to be quickly and accurately performed. As will be described in greater detail below, to provide quicker, more accurate, and consistent horizontal positioning (in an x-y plane) of cutting reel 20 relative to a shaft of a grinding reel, and thereby provide accurate and consistent "squaring/trueing" and relief grinding processes, grinding system 50 includes moveable mounting brackets that releasably secure to the rear roller 14 of mower unit 10 (or to another predefined point on mower unit 10 that is at a known, fixed distance from shaft 24 of cutting reel 20). The mounting brackets are moveable linearly in the horizontal plane (x-y plane) to one of a number of predetermined positions along a positioning axis based on characteristics of the mower reel unit 10 (where such characteristics include the manufacturer of mower unit 10 and the size of cutting reel 20, for example) so as to place the cutting reel 20 at a desired horizontal position relative to the shaft/axis of the grinding wheel, which is at fixed horizontal position (i.e., in the x-y plane).

As described below, the rear mounting brackets are linearly moveable in the horizontal plane (x-y plane) to preselected positions corresponding to different types of mower units (e.g., different models and manufacturers), and are rotatable together as a unit about a pivot axis so as to provide quick and accurate horizontal alignment of reel 20 (i.e., in a horizontal x-y plane) relative to a grinding wheel axis that is at a fixed horizontal position to thereby enable accurate and reproducible spin grinding and relief grinding processes. Additionally, each end of the grinding axis of the grinding wheel is independently adjustable in the vertical direction (i.e., in the x-z plane) to enable touch-off grinding of reel 20. In other examples, grinding system 50 further includes a controller that provides automated paralleling of rotational axis 24 of reel 20 with the grinding wheel axis in at least the vertical plane based on inputs from one or more alignment gauges. As such, according to examples which will be described in greater detail herein, grinding system 50 enables accurate spin and relief grinding processes while also enabling touch-off grinding.

With reference to FIG. 3, in one example, grinding system 50 includes a mounting platform 60 including a plurality of sets of predetermined positions (e.g., holes) 62 at which mounting brackets 64 can be positioned, where each set of predetermined positions corresponds to at least one type of mower unit, such as a particular model from a particular manufacturer (including different reel diameters and widths, for example. For example, see U.S. Pat. No. 9,776,297, which is incorporated herein by reference. In one example, mounting platform 60 and, thus, mounting brackets 64, is rotatable in the horizontal plane (x-y plane) about a pivot point/axis 66, as indicated by rotational arrow 68, via a horizontal adjustment mechanism 65 (such as wheel 65). Locking mechanisms 69 are operable to secure mounting platform (and mounting brackets 64), at a desired position in the horizontal plane (such as parallel to a grinding wheel axis, for example), after mounting platform 60 has been rotated about pivot axis 66 to a desired position via operation of hand-wheel 65.

A clamping assembly 70 includes a flange 72 to secure a rear roller 14 to mounting brackets 64 (v-brackets) via a locking mechanism 74 (e.g., a cam mechanism).

A front mounting assembly 80 includes a vertically adjustable support pedestal 82 and a clamping mechanism 84 to secure to a front roller 16 of a mower unit 10.

A spin drive motor 90 is employed to couple to shaft 24 and to drive/spin a reel 20 of a mower unit 10 mounted to grinding system 50. In one example, spin drive motor 90 is mounted to an articulating arm system 92.

Figure 4A:
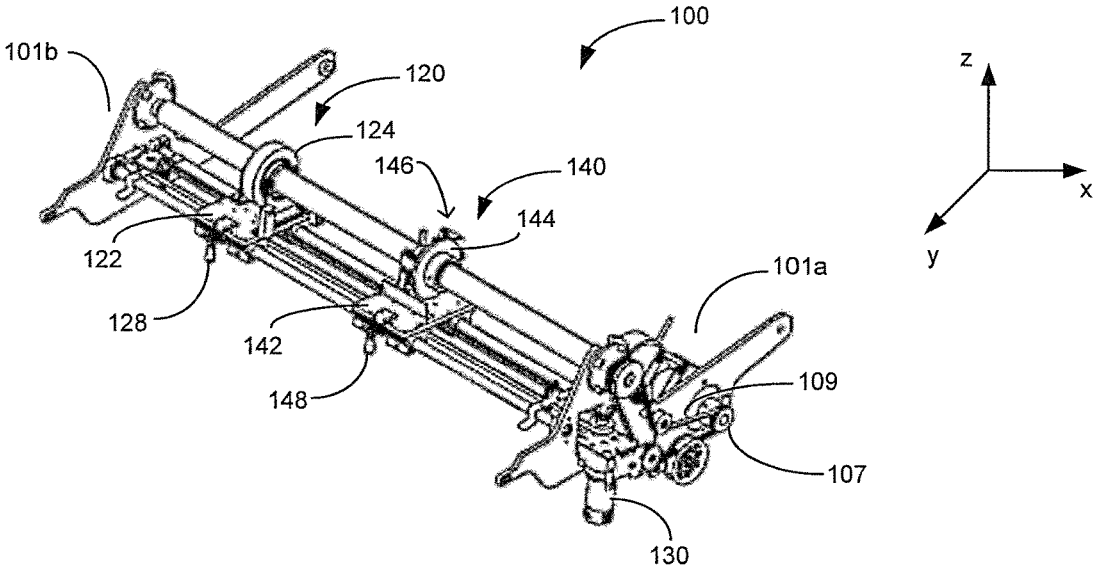
FIGS. 4A-4D illustrate examples of a traverse base assembly including spin-grinding and relief grinding assemblies according to one example
Figure 4B:
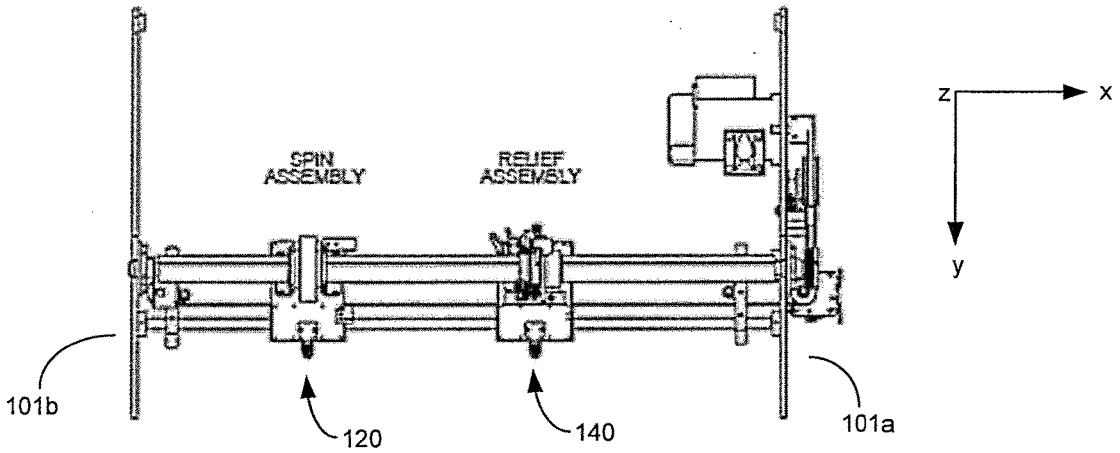
Figure 4C:
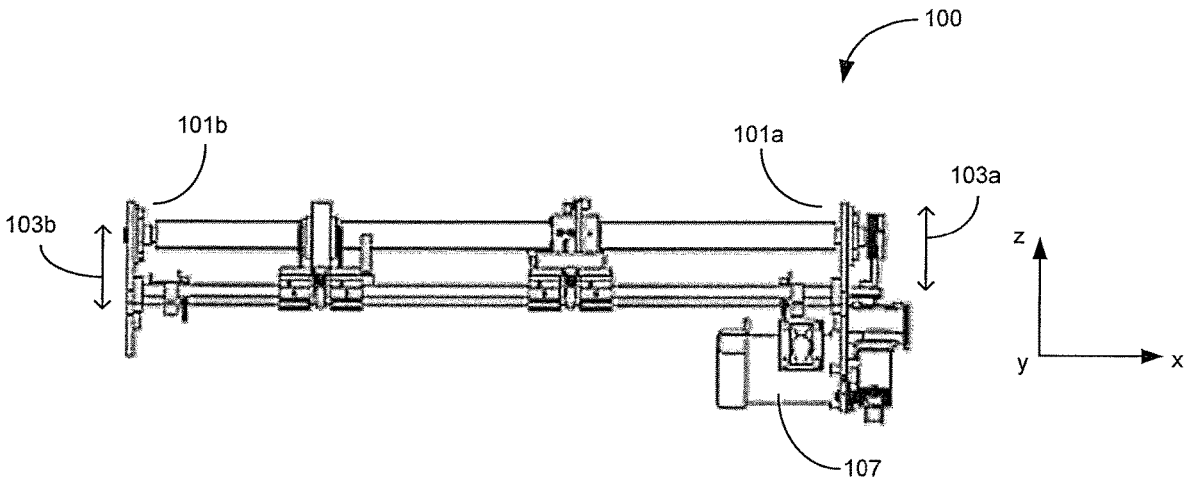
Figure 4D:
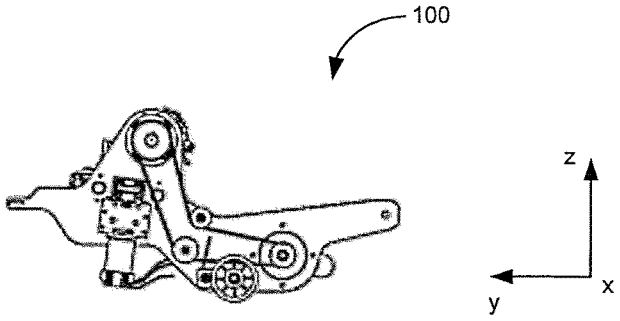

A traverse base assembly 100 includes end plates 102*a* and 102*b* between which a guide system 104, such as guide rods 104*a* and 104*b*, and a grinding shaft 106 (having a grinding axis 108) extend. In one example, grinding shaft 106 is driven by a grinder drive motor 107 via a belt 109 (see FIG. 4C).

In one example, a spin-grinding assembly 120, including a spin-grinding carriage 122 and a spin-grinding wheel 124, is mounted to traverse base assembly 100, with carriage 122 slideably coupled to guide rods 104*a*/104*b*, and spin-grinding wheel 124 coupled to grinding shaft 106. In one example, spin-grinding assembly 120 is driven back and forth along guide rods 104*a*/104*b* and grinding shaft 106 by drive motor 130 via drive belt 132.

With reference to FIGS. 4A-4D, which respectively illustrate perspective, top, front, and side views of traverse base assembly 100, according to one example, a relief-grinding assembly 140 is also mounted to traverse base assembly 100. In one example, a relief-grinding assembly 140 includes a relief-grinding carriage 142, a relief-grinding wheel 144, and a relief grinding index/guide assembly 146 (see U.S. Pat. Nos. 6,290,581 and 9,776,297, each of which are incorporated herein by reference), with relief-grinding carriage 142 slideably coupled to guide rods 104*a*/104*b*, and relief-grinding wheel 144 coupled to grinding shaft 106. In one example, relief-grinding assembly 140 is driven back and forth along guide rods 104*a*/104*b* and grinding shaft 106 by a drive motor 130 via a drive belt 132.

In one example, spin-grinding assembly 120 and relief-grinding assembly 140 are separately coupled to guide system 104 via engagement mechanisms 128 and 148.

In one example, traverse base assembly 100, including guide system 104, grinding shaft 106, spin-grinding system 120, relief-grinding system 140, and drive motors 107 and 130, is vertically adjustable at each end (such as right end 101*a* and left end 101*b*) via respective vertical adjustment systems 150 and 160. In one example, vertical adjustment systems 150 and 160 each include respective hand wheels 152 and 162 for vertically adjusting (i.e., in the z-direction) the right and left ends 101*a* and 101*b* of traverse base assembly 100 (see arrows 103*a*/103*b* in FIG. 4C). In one example, adjustment systems 150 and 160 each include and adjustment motor 154 and 164 for vertically adjusting the right and left ends 101*a* and 101*b* of traverse base assembly 100, based on inputs from one or more measurement gauges (which will be described in greater detail below). In one example, adjustment system 150 includes both wheel 152 and motor 154, and adjustment system 160 includes both wheel 162 and motor 164.

Figure 5:
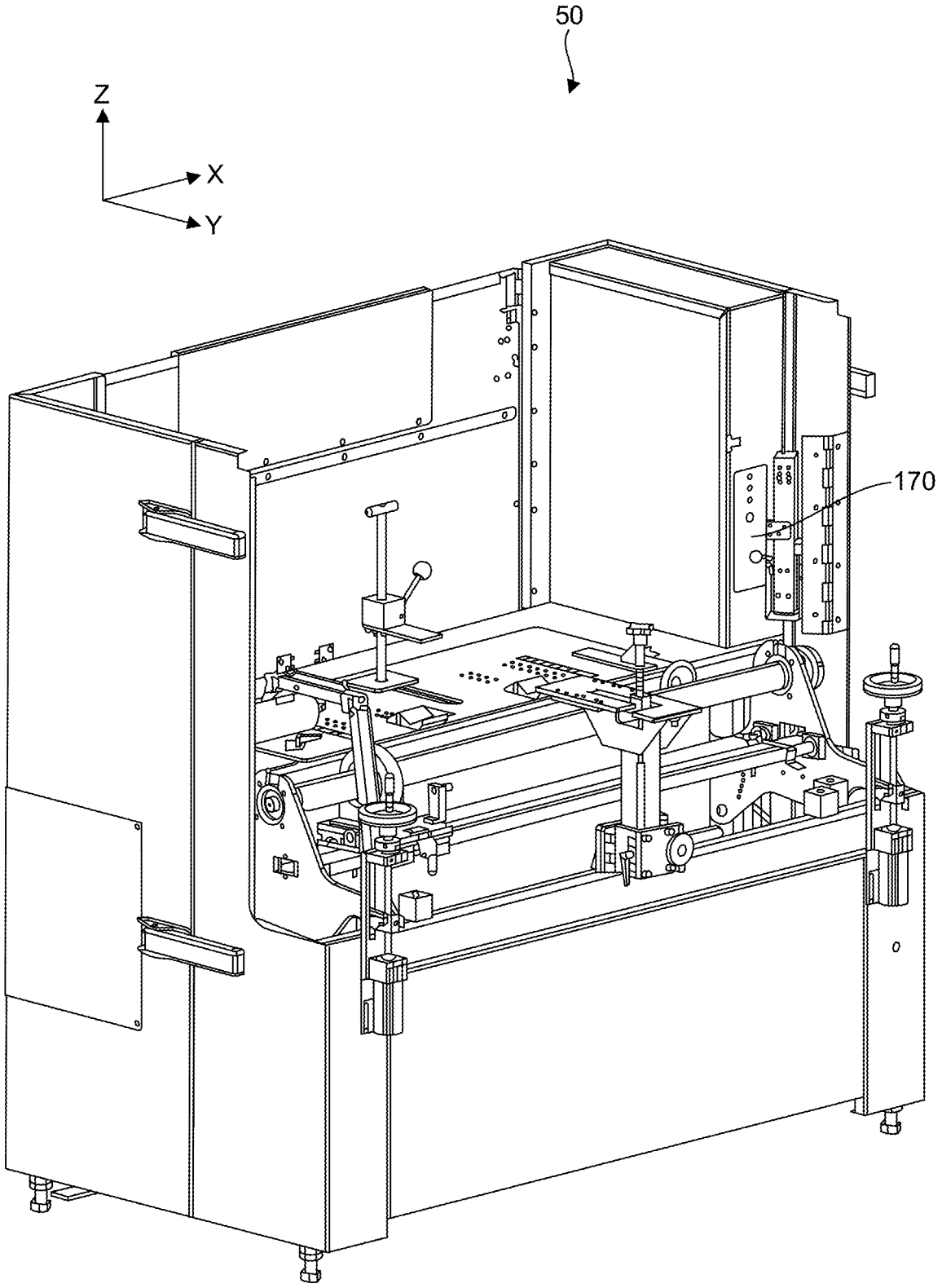
FIGS. 5-7 are perspective views of a grinding system according to examples of the present disclosure.

FIG. 5 is another perspective view of grinding system 50, and illustrates a controller 170.

Figure 6:
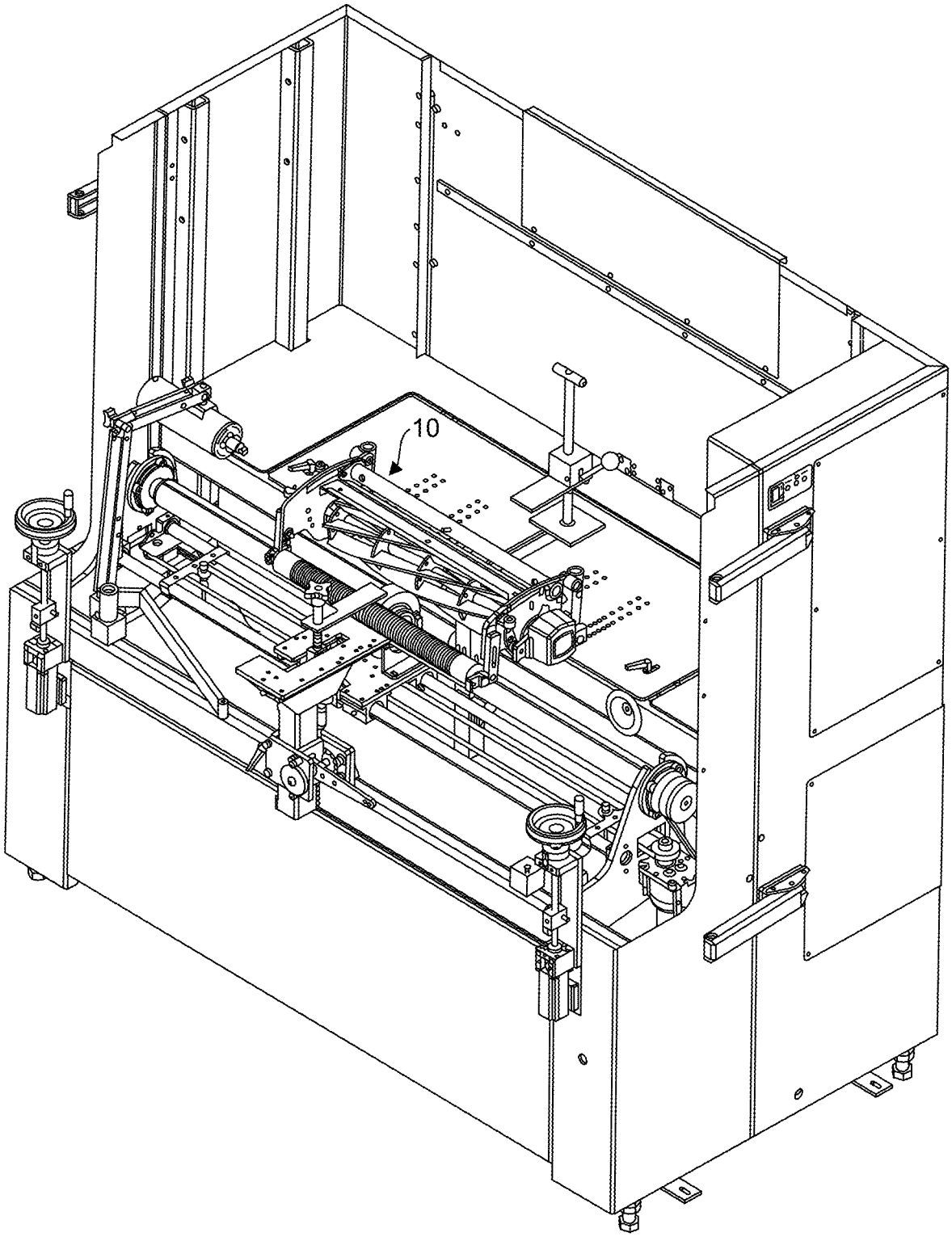
Figure 7:
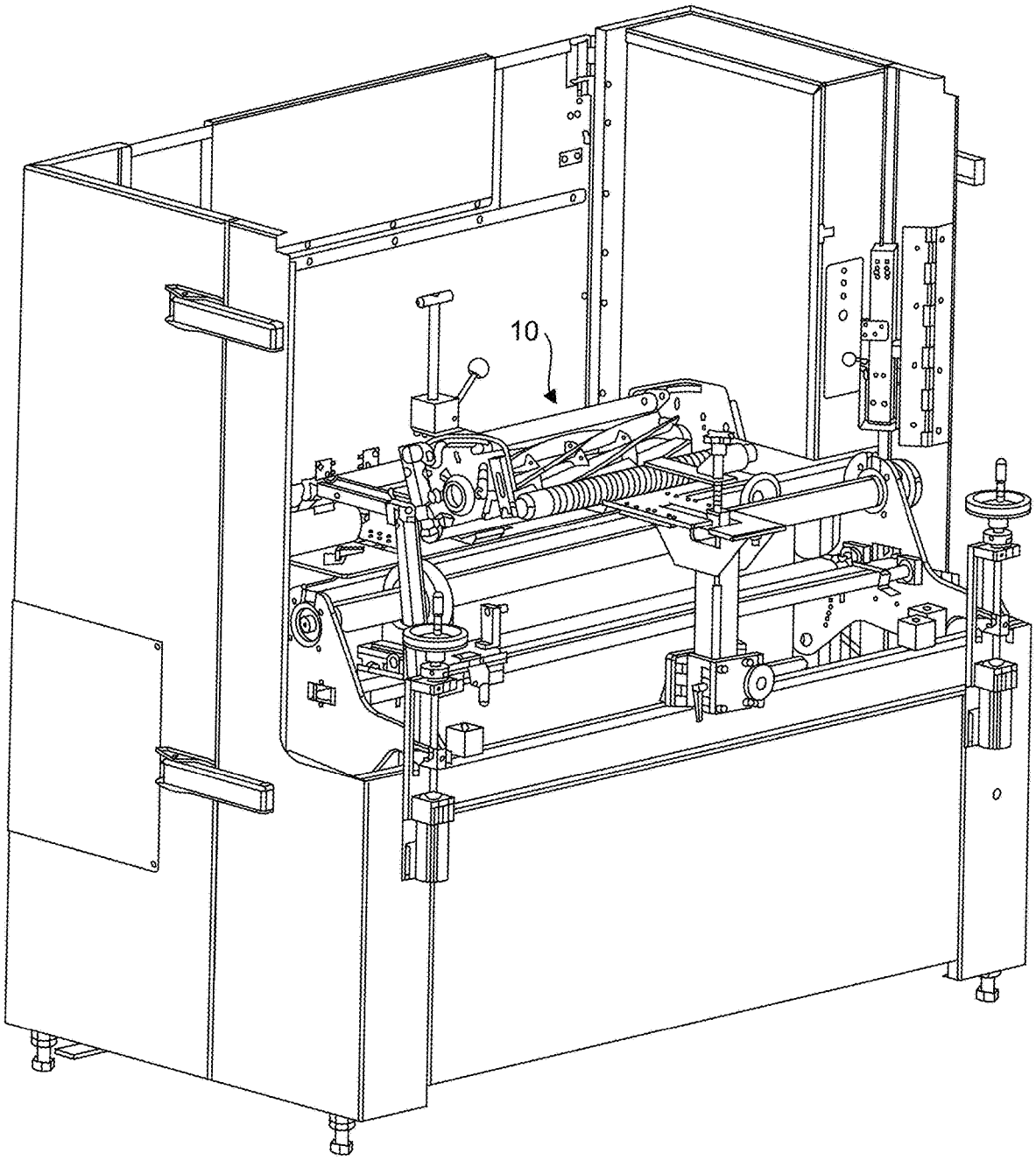
Figure 8:
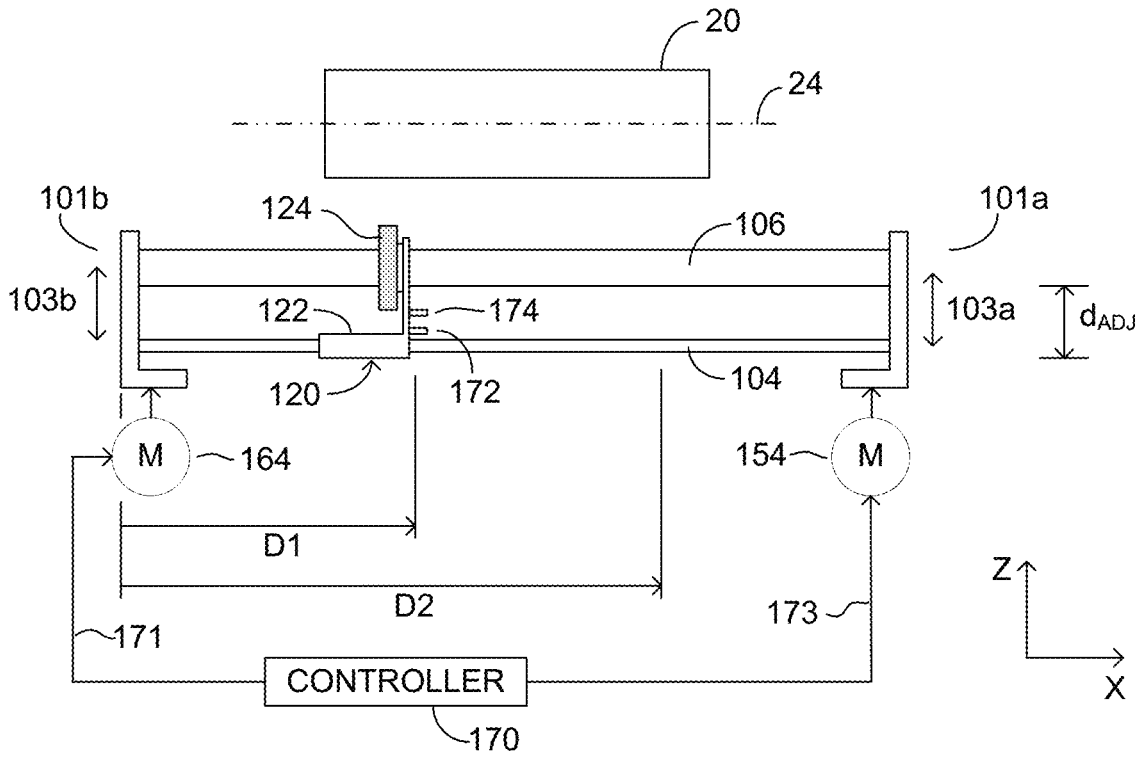
FIGS. 8-11 are block and schematic diagrams generally illustrating a grinding system and process according to examples of the present disclosure.

FIGS. 6 and 7 are perspective views of grinding system 50 with a mower unit 10 having a rear roller 14 mounted to rear brackets 64 and a front roller 16 secured to support pedestal 82 of front mounting assembly 80 via clamp 84.

FIGS. 8-11 generally illustrate a system and method of carrying out a trueing/squaring grinding process, according to one example. In one example, to begin the grinding process, a user sets the left end 101*b* of traverse assembly 100 to a zero position so that grinding shaft 106 is at a known vertical position at left end 101*b*. In one example, a user sets the left end 101*b* to the zero position via wheel 162. In one example, a user sets the left end 101*b* to the zero position by initiating a spin-grinding process via controller 170, whereby controller 170 sets left end 101*b* to the zero position by controlling drive motor 164 via a control line 171.

Figure 10:
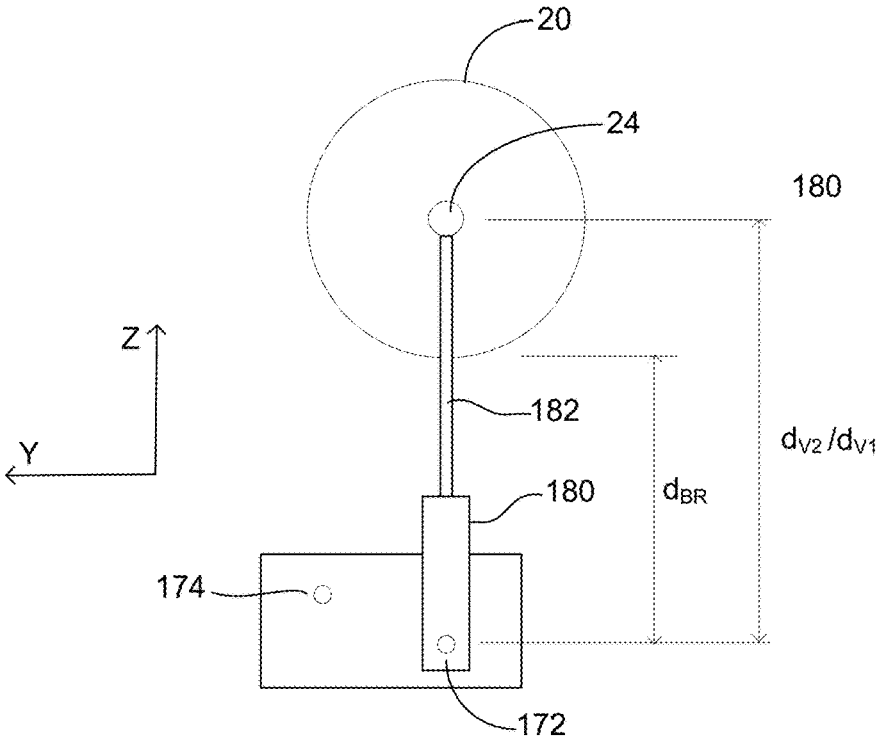
Figure 11:
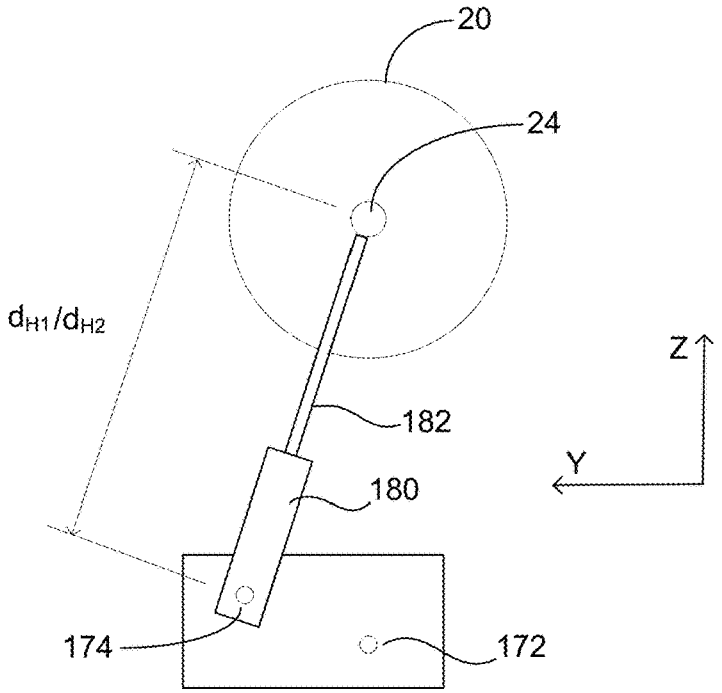

In one example, after the left end 101*b* is set to the zero position, spin-grinding carriage 122 is moved to location D2 (which is at a known distance D2 from left end 101*b* of traverse base assembly 100). With reference to FIG. 10, after spin-grinding carriage 122 has been moved to location D2, an electronic linear distance gauge 180 is mounted on a first mounting element 172 so as to be positioned vertically with the rotational shaft 24 of reel 20 and provides, via an extendable shaft 182 (e.g., spring loaded shaft), a measurement of the distance to the perimeter of reel 20 (i.e., an edge of a helical blade at its lowest point) to controller 170. In one example, a user then adjusts the height of support pedestal 82 until controller 170 indicates that the lowest perimeter edge of reel 20 is at a desired height $d_{BR}$ from spin-grinding carriage 122.

After the desired height $d_{BR}$ has been achieved, as illustrated by FIG. 10, while still mounted on first mounting element 172 and at the first location D2, reel 20 is rotated until electronic liner distance gauge 180 provides a measurement of the distance $d_{V2}$ to rotational shaft 24 of reel 20 to controller 170.

Spin grinding carriage 122 is then moved to location D1 (which is at a known distance D2 from left end 101*b* of traverse base assembly 100). When at position D1, similar to that illustrated by FIG. 10, electronic liner distance gauge 180 provides a measurement of the distance $d_{V1}$ to rotational shaft 24 of reel 20 to controller 170.

Based on the known distances D2 and D1 from the left end 101*b* of traverse base assembly 100 at which vertical distance measurements $d_{V2}$ and $d_{V1}$ were taken, controller 170 determines a distance $d_{ADJ}$ by which to adjust right end 101*a* of traverse base assembly 100 so that grinding shaft 106 is vertically paralleled with rotational axis 24 of cutting reel 20. In one example, controller 170 adjusts the height of right end 101*a* of traverse assembly 100 by the distance $d_{ADJ}$ by operating drive motor 154 via control line 173. In one example, a user may adjust the height of right end 101*a* by the distance $d_{ADJ}$ via wheel 152 (with controller 170 providing indication of proper adjustment via a set of indicating lights, e.g., raise, lower, stop lights).

In one example, after vertical alignment has been achieved between grinding shaft 106 and rotational shaft 24, horizontal alignment is made between grinding shaft 106 and rotational shaft 24 of reel 20. Similar to that described above with regard to vertical alignment, during horizontal alignment, measurements $d_{H2}$ and $d_{H1}$ of the distance to the rotational shaft 24 of reel 20 are again taken at locations D2 and D1, except with the electronic linear distance gauge 180 mounted on pin 174 in instead of on pin 172 (see FIG. 11). In a similar fashion to that described above with respect to the vertical adjustment, controller 170, based on measurements $d_{H2}$ and $d_{H1}$, determines a rotational adjustment, $R_{ADJ}$, which is required to be made to mounting platform 60 about pivot 66 so that grinding shaft 106 is horizontally paralleled with rotational shaft 24 of reel 20. In one example, the adjustment can be made by a user via wheel 65 with indication provided controller 170 via a set of indicating lights, or made automatically via a motor (not shown) controlled by controller 170. In one example, is noted that when at the second mounting position 172, measuring gauge 180 must be at an angle of 20 degrees or greater from vertical, as measured from a vertical line extending through rotational shaft 24.

Figure 9:
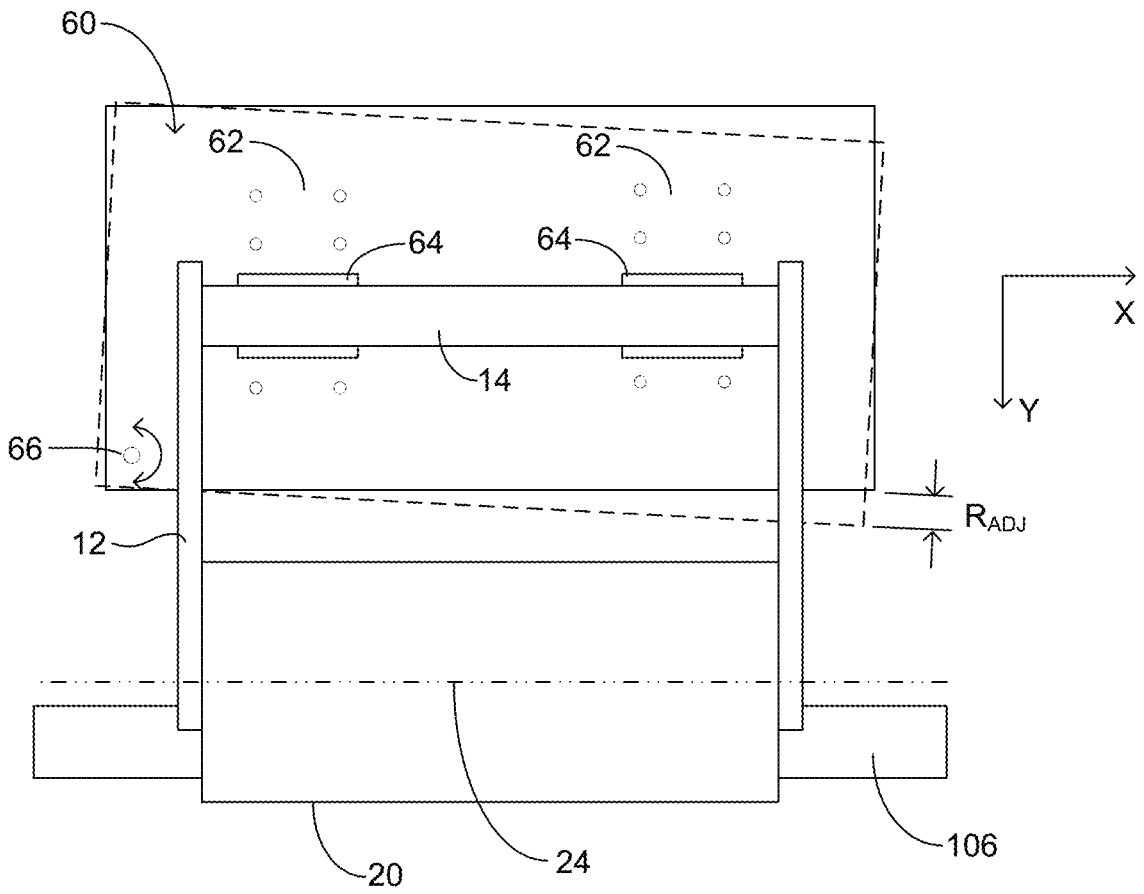

FIG. 9 is a block and schematic illustrating a simplified top view of a mower unit 14 mounted on brackets 64 of rotating mounting plate 60 via rear roller 14, where the dashed lines indicate and initial position of mounting plate 60, and the solid lines indicate a position of mounting plate 60 about pivot axis 66 by the amount $R_{ADJ}$ so that axis 24 of cutting reel 20 is paralleled with grinding axis 106 in the x-y plane. It is noted that grinding axis 106 is fixed in the x-y plane, while mounting plate 60 is fixed in the x-z plane.

After grinding shaft 106 has been both vertically and horizontally aligned with rotational shaft 24 of reel 20, a trueing/squaring grinding process is carried out to square or true reel 20 to a cylinder. In one example a relief grinding process may carried out thereafter using relief grinding assembly 140. It is noted that spin grinding assembly 120 and relief grinding assembly 140 are separately and independently coupled to grinding shaft 106 and guide assembly 104 during the spin and relief grinding processes.

Although illustrated as a mechanical gauge, any suitable type of measuring gauge may be employed for gauge 180, such as a laser gauge, for example. In one example, two laser gauges may be mounted to carriage 122, one at each location 172 and 174.

In another mode, grinding system 50 enables touch-off grinding via manual vertical adjustment of grinding shaft 106 via wheels 152 and 154, wherein such touch-off grinding is improved based on use of rear brackets 64 being moveable to horizontal positions corresponding to the type of mower unit being sharpened and to grinding shaft 106 being fixed in the horizontal plane. Such touch-off grinding is performed by independently moving the opposing ends 101*a* and 101*b* in the z-direction to parallel grinding shaft 106 with the perimeter surface 21 of cutting reel 20.

In a trueing/squaring grinding process, grinding system 50 provides accurate trueing or squaring of cutting reels to cylinder shapes based on the use of rear mounting brackets 64 and the paralleling of grinding shaft 106 with rotational shaft 24 of reel 20 via the gauging and alignment system described herein. In another mode, grinding system 50, in addition to providing spin-grinding for trueing the reels to their desired cylindrical shape, further provides relief grinding via relief grinding assembly 140.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A mower reel grinding system for a plurality of mower unit types, comprising:

a grinding wheel shaft, the grinding wheel shaft at a fixed and non-adjustable position in an x-y plane and adjustable only in a x-z plane perpendicular to the x-y plane;

a mounting plate including:

a number of predetermined fixed mounting positions on the mounting plate, each predetermined fixed mounting positions corresponding to at least one type of mower unit of the plurality of mower unit types;

a mounting bracket to receive a mower unit, the mounting bracket selectively moveable to the predetermined fixed position corresponding to the mower unit type to be received thereby;

a pivot point about which the mounting plate rotates in an x-y plane to adjust a position of the mounting bracket in the x-y plane relative to the grinding wheel shaft.

2. The mower reel grinding system of claim 1, including:

a locking mechanism to lock the mounting plate at any rotated position.

3. The mower reel grinding system of claim 1, including:

a hand wheel to rotate the mounting plate about the pivot point.

4. The mower reel grinding system of claim 1 including:

a first adjustment mechanism to adjust a position of a first end of the grinding wheel shaft in the z-direction; and a second adjustment mechanism to adjust a position of an opposing second end of the grinding wheel shaft in the z-direction, such that the first and second adjustment mechanisms adjust the position of the grinding wheel shaft in the x-z plane.

5. The mower reel grinding system of claim 4, the first and second adjustment mechanisms each comprising a hand wheel.

6. The mower reel grinding system of claim 4, the first and second adjustment mechanism each comprising a motor controlled by a controller to adjust the first and second ends of the grinding wheel shaft in the z-direction.

7. The mower reel grinding system of claim 1, the predetermined fixed mounting positions comprising a number of sets of mounting holes in the mounting plate, each set of mounting holes corresponding to at least one mower unit type.

8. The mower reel grinding system of claim 1, where mower unit type is defined by a number of characteristics including a manufacturer of the mower unit, a diameter of the cutting reel, and a number of helical cutting blades on the cutting reel.

9. The mower reel grinding system of claim 1, the mounting bracket configured to receive a rear roller of a mower unit.

10. A mower reel grinding system for sharpening a plurality of mower unit types, each mower unit type including a cutting reel having a rotational axis, comprising:

a grinding wheel shaft, the grinding wheel shaft at a fixed and non-adjustable position in an x-y plane defined by an x-axis and a y-axis, and adjustable only in an x-z plane perpendicular to the x-y plane define by the x-axis and a z-axis;

a mounting plate including:

a number of predetermined fixed mounting positions on the mounting plate, each predetermined fixed mounting positions corresponding to at least one type of mower unit of the plurality of mower unit types;

a mounting bracket to receive and secure to a rear roller of a mower unit, the mounting bracket selectively moveable to the predetermined fixed position corresponding to the mower unit type to be received by the mounting bracket so to position the rotational axis of the cutting reel a desired position along the x-axis;

a single pivot point about which the mounting plate is rotatable in the x-y plane to adjust a position of the mounting bracket in the x-y plane so as to parallel the rotational axis of the cutting reel to the grinding wheel shaft when a mower unit is secured to the mounting bracket, the single pivot point at a fixed location which is independent of a location of the mounting bracket.

11. The mower reel grinding system of claim 10, including:

a traverse base assembly to which the grinding wheel shaft is mounted, the traverse base assembly including:

a guide system along which a spin-grinding system carriage and a relief grinding system carriage are independently driven back and forth in a reciprocating fashion parallel to the grinding wheel shaft;

a spin-grinding wheel mounted to the spin-grinding system carriage to selectively couple to the grinding wheel shaft, the spin-grinding wheel rotationally driven about the grinding wheel shaft by a grinder-drive rotationally driving the grinding wheel shaft; and a relief grinding wheel mounted to the relief grinding system carriage and to selectively be coupled to the grinding wheel shaft, the relief grinding wheel rotationally driven about the grinding wheel shaft by the grinder drive motor rotationally driving the grinding wheel shaft.

12. The mower reel grinding system of claim 11, including:

a first adjustment mechanism to adjust a position of a first end of the traverse base assembly in the z-direction; and a second adjustment mechanism to adjust a position of an opposing second end of the traverse base assembly in the z-direction, so as to adjust a position of the grinding wheel shaft in the x-z plane perpendicular to the x-y plane to parallel the grinding wheel shaft with the rotational shaft of the cutting reel in the x-z plane.

13. A method of sharpening a plurality of mower unit types, each mower unit type having a rear roller and a cutting reel having a rotational axis, the method comprising:

moving a mounting bracket on a mounting plate to a predetermined fixed mounting position corresponding to the type of mower unit to be sharpened, the mounting plate including a plurality of predetermined fixed mounting positions each corresponding to at least one mower unit type;

mounting a rear roller of the mower unit to be sharpened to the mounting bracket;

rotating the mounting plate in an x-y plane about a single pivot point to parallel the rotational axis of the cutting reel to a grinding wheel shaft the grinding wheel at a fixed, non-adjustable position in the x-y plane, the mounting plate being at a fixed position in an x-z plane which is perpendicular to the x-y plane.

14. The method of claim 13, including:

adjusting a position of the grinding wheel shaft in the x-z plane to parallel the grinding wheel shaft to the rotational axis of the cutting reel.

15. The method of claim 14, wherein adjusting a position of the grinding wheel shaft includes independently adjusting opposing ends of the grinding wheel shaft in the z-direction manually with a hand wheel and automatically with a motor via a control unit.

* * * * *